US007469821B2

(12) United States Patent
Otsuka et al.

(10) Patent No.: US 7,469,821 B2
(45) Date of Patent: Dec. 30, 2008

(54) IMAGE FORMING APPARATUS AND PROCESSING UNIT USED FOR THE SAME

(75) Inventors: Yoshinori Otsuka, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 547 days.

(21) Appl. No.: 11/150,076

(22) Filed: Jun. 10, 2005

(65) Prior Publication Data

US 2005/0279821 A1 Dec. 22, 2005

(30) Foreign Application Priority Data

Jun. 16, 2004 (JP) ..... 2004-178496

(51) Int. Cl.
*B41J 32/00* (2006.01)

(52) U.S. Cl. ..... 235/375; 347/214

(58) Field of Classification Search ..... 235/375; 347/19, 214; 399/12, 27
See application file for complete search history.

(56) References Cited

U.S. PATENT DOCUMENTS

| | | | | |
|---|---|---|---|---|
| 5,365,312 | A * | 11/1994 | Hillmann et al. | 399/12 |
| 5,835,817 | A * | 11/1998 | Bullock et al. | 399/25 |
| 5,949,467 | A * | 9/1999 | Gunther et al. | 347/214 |
| 6,173,127 | B1 | 1/2001 | Glover et al. | |
| 6,490,422 | B2 | 12/2002 | Harumoto | |
| 6,658,219 | B1 * | 12/2003 | Ito et al. | 399/27 |
| 6,978,255 | B1 * | 12/2005 | Pauschinger et al. | 705/61 |
| 6,984,012 | B2 * | 1/2006 | Asauchi | 347/19 |
| 2003/0063914 | A1 | 4/2003 | Masuda et al. | |
| 2003/0170049 | A1 * | 9/2003 | Itoh et al. | 399/258 |
| 2004/0101320 | A1 | 5/2004 | Haramoto | |
| 2005/0141901 | A1 * | 6/2005 | Lee | 399/12 |

FOREIGN PATENT DOCUMENTS

| | | |
|---|---|---|
| CN | 1410846 | 4/2003 |
| CN | 1503077 | 6/2004 |
| JP | 10-260577 | 9/1998 |
| JP | 2001-096845 | 4/2001 |
| JP | 2002-062784 | 2/2002 |
| JP | 2003-039783 | 2/2003 |
| JP | 2003-182108 | 7/2003 |
| JP | 2003-233277 | 8/2003 |

* cited by examiner

*Primary Examiner*—Daniel A Hess
(74) *Attorney, Agent, or Firm*—Renner, Otto, Boisselle & Sklar, LLP

(57) ABSTRACT

Provided is an image forming apparatus which displays display information regarding product liability, which is read out from a storage medium of a processing unit, the image forming apparatus carrying out judgment as to whether or not the processing unit is a genuine/recommended product based on the information read out from the storage medium. The image forming apparatus carries out a series of image forming process when the processing unit is a genuine or a recommended product. On the other hand, when the processing unit is an unauthorized product, the image forming apparatus displays the display information and/or the comparison result. On this account, the user can easily and securely confirm display information regarding product liability of the processing unit, and/or information regarding compatibility of the processing unit with the image forming apparatus, while ensuring superior security and reliability.

14 Claims, 8 Drawing Sheets

FIG. 3

DISPLAY INFORMATION M

| ADDRESS | CONTENTS |
|---|---|
| 0000H~003FH | PROCESSING UNIT PRODUCT NAME , MANUFACTURER'S SERIAL NUMBER ~M1 |
| 0040H~007FH | PROCESSING UNIT NAME OF MANUFACTURER |
| 0080H~00BFH | CONTENT PRODUCT NAME |
| 00C0H~00FFH | CONTENT NAME OF MANUFACTURER |
| 0100H~013FH | CONTENT MATERIAL |
| 0140H~017FH | CONTENT AMOUNT |
| 0180H~01BFH | CONTENT EXPIRATION DATE |
| 01C0H~01FFH | PROCESSING UNIT CUMULATIVE NUMBER OF PRINTED SHEETS |
| 0100H~013FH | PROCESSING UNIT NUMBER OF RECYCLES |
| 0140H~017FH | CURRENT CONTENT CUMULATIVE NUMBER OF PRINTED SHEETS |
| 0180H~01BFH | CURRENT CONTENT REMAINING AMOUNT |
| 0200H~023FH | RECYCLE HISTORY |
| 0240H~027FH | PROCESSING UNIT MANUFACTURER'S CONTACT ADDRESS |
| 0280H~02BFH | CONTENT MANUFACTURER'S CONTACT ADDRESS |
| 02C0H~02FFH | CONTACT DETAILS OF MAINTENANCE SERVICE |
| 0300H~033FH | MANUFACTURING DATE |

FIG. 4

COMPARISON INFORMATION N

| ADDRESS | CONTENTS |
|---|---|
| 0000H | A UNIT , A0001 |
| 0001H | B UNIT , B01 |
| 0002H | C UNIT , C01 |
| ⋮ | ⋮ |

IMAGE FORMING APPARATUS AND PROCESSING UNIT USED FOR THE SAME

This Nonprovisional application claims priority under 35 U.S.C. § 119(a) on patent application Ser. No. 2004/178496 filed in Japan on Jun. 16, 2004, the entire contents of which are hereby incorporated by reference.

FIELD OF THE INVENTION

The present invention relates to an image forming apparatus which reads out display information regarding product liability of a replaceable processing unit, which is mounted to the image forming apparatus as a part of image forming function, so as to carry out a predetermined operation according to the information. The present invention further relates to the processing unit.

BACKGROUND OF THE INVENTION

An image forming apparatus, constituted as a printer, photocopier, facsimile, or a multi-functional device with all of these functions, generally includes a changeable or recyclable processing unit, such as a toner cartridge or a process cartridge. For the processing unit, it is preferable to use a genuine product or a recommended product (licensed product of the manufacturer) supplied from the manufacturer of the image forming apparatus or a fabricant only in charge of production (hereinafter, they are both referred to as a manufacturer), the operation and performance of which is ensured by the manufacturer.

However, in recent years, unauthorized products are distributed to be used as the processing unit, the unauthorized products are not manufactured by the manufacturer of the image forming apparatus, and the operation and performance thereof are not guaranteed.

To avoid the problem of various defects due to the use of such an unauthorized product, Japanese Laid-Open Patent Application Tokukai 2003-39783 (published on Feb. 13, 2003) discloses a cartridge including an IC memory tag for storing information to distinguish the genuine product and recommended product from unauthorized product.

The image forming apparatus using the cartridge including an IC memory tag is capable of checking whether or not the processing unit is an unauthorized cartridge with an IC memory tag by reading out the information stored in the memory tag. Then, by informing the user of necessity of exchange of the cartridge with an IC memory tag, the use is protected from undesired use of unauthorized product.

However, some users prefer unauthorized products because of the low cost, even though they are aware of danger of possible defects.

When any defect is found in the product, the manufacturer is responsible for the damage according to the Product Liability (PL) Law (for chattels supplied through artificial operation or processing, such as industry products which are mass-produced and mass-consumed). However, if the trouble occurs with the use of unauthorized product, the manufacturer is not responsible for the damage, and may raise a dispute as to who is responsible for the loss caused by the defect.

For example, the manufacturers make efforts to reduce such a dispute as much as possible by warning the user non-guarantee of quality when the image forming apparatus is used with an unauthorized product, or supplying information of harmful condition inducing various defects, or inadequate use so as to ensure safe use of the apparatus. Therefore, the user of the image forming apparatus needs to confirm the warning or information given by the manufacturer so as to ensure the guarantee from the manufacturer. The warning or information may include the name of manufacturer of products, the date of manufacturing, or an identification of genuine product or recommended product.

The information display regarding product liability is generally given to the user in the form of a written notice attached to the main body of the product, the wrapping, or is written in the manual. However, fully understanding of given warning regarding use of the image forming apparatus is quite a trouble for the user; besides the confirmation is not possible if the medium containing the information is lost.

Moreover, many of image forming apparatuss have a function of estimating appropriate timing of exchange of the processing unit and informing the user of the estimation result, so that the user is able to change the unit at an appropriately timing. However, when an unauthorized product much lower in quality than a genuine product or a recommended product is used, it may decrease the life or function of the unauthorized product itself or other processing units mounted to the image forming apparatus.

Here, the estimation for exchange timing is made with assumption that the apparatus uses a genuine product or a recommended product, thus, when an unauthorized product is used, an appropriate exchange timing cannot be estimated. More specifically, because there is an error between the estimation result and actually-required exchange timing, a worn out processing unit may be continuously used without being exchanged, which may cause improper image forming or the like.

SUMMARY OF THE INVENTION

An object of the present invention is to provide an image forming apparatus which allows the user to easily and securely confirm display information regarding product liability of a processing unit, and/or information regarding compatibility of the processing unit with the image forming apparatus. With this function, the image forming apparatus achieves superior security and reliability. The present invention further provides the processing unit used for the image forming apparatus.

In order to solve the foregoing problems, the image forming apparatus, comprising: a reading section which reads out information stored in a storage medium of a replaceable processing unit, which is mounted to the image forming apparatus as a part of image forming function; a display section for displaying information; reading controlling means for causing the reading section to read display information regarding product liability, which is stored in the storage medium; a first storage section which at least stores comparison information used for identification of the display information read by the reading section; comparing means for comparing the display information read by the reading section with the comparison information stored in the first storage section; and display controlling means for displaying one or both of the display information and a comparison result given by the comparing means.

With the foregoing arrangement, the reading controlling means causes the reading section to read out the display information regarding product liability, which is stored in the storage medium of a replaceable processing unit; and the first storage section stores comparison information used for identification of the display information read by the reading section. Further, the comparing means carries out comparison between the display information read by the reading section and the comparison information stored in the first storage section, and the display controlling means displays one or both of the display information and the comparison result given by the comparing means in the display section.

With this function, the present invention provides an effect that the user easily and securely confirms display information regarding product liability of a processing unit, and/or information regarding compatibility of the processing unit with the image forming apparatus.

On this account, it is possible to provide an image forming apparatus which allows the user to easily and securely confirm the display information regarding product liability of the processing unit, and/or information regarding compatibility of the processing unit with the image forming apparatus, while ensuring superior security and reliability of the image forming apparatus.

A processing unit according to the present invention is a replaceable processing unit mounted to the image forming apparatus as a part of image forming function, the processing unit including a storage medium storing at least display information regarding product liability.

By mounting the processing unit to the image forming apparatus of the present invention, the user can easily and securely confirm the display information regarding product liability of a processing unit, and/or information regarding compatibility of the processing unit with the image forming apparatus. Moreover, superior security and reliability of the image forming apparatus are ensured.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3 is a drawing showing an example of display information M.

FIG. 4 is a drawing showing an example of comparison information N.

DESCRIPTION OF THE EMBODIMENTS

Various embodiments of the present invention will be described below with reference to FIGS. 1 and 8.

To specifically describe the features of the present invention, one embodiment of the present invention is described with reference to Figures. The embodiment below however is only an example of enforcement of the present invention, and is not to limit scope of the present invention.

First Embodiment

Figure 1:
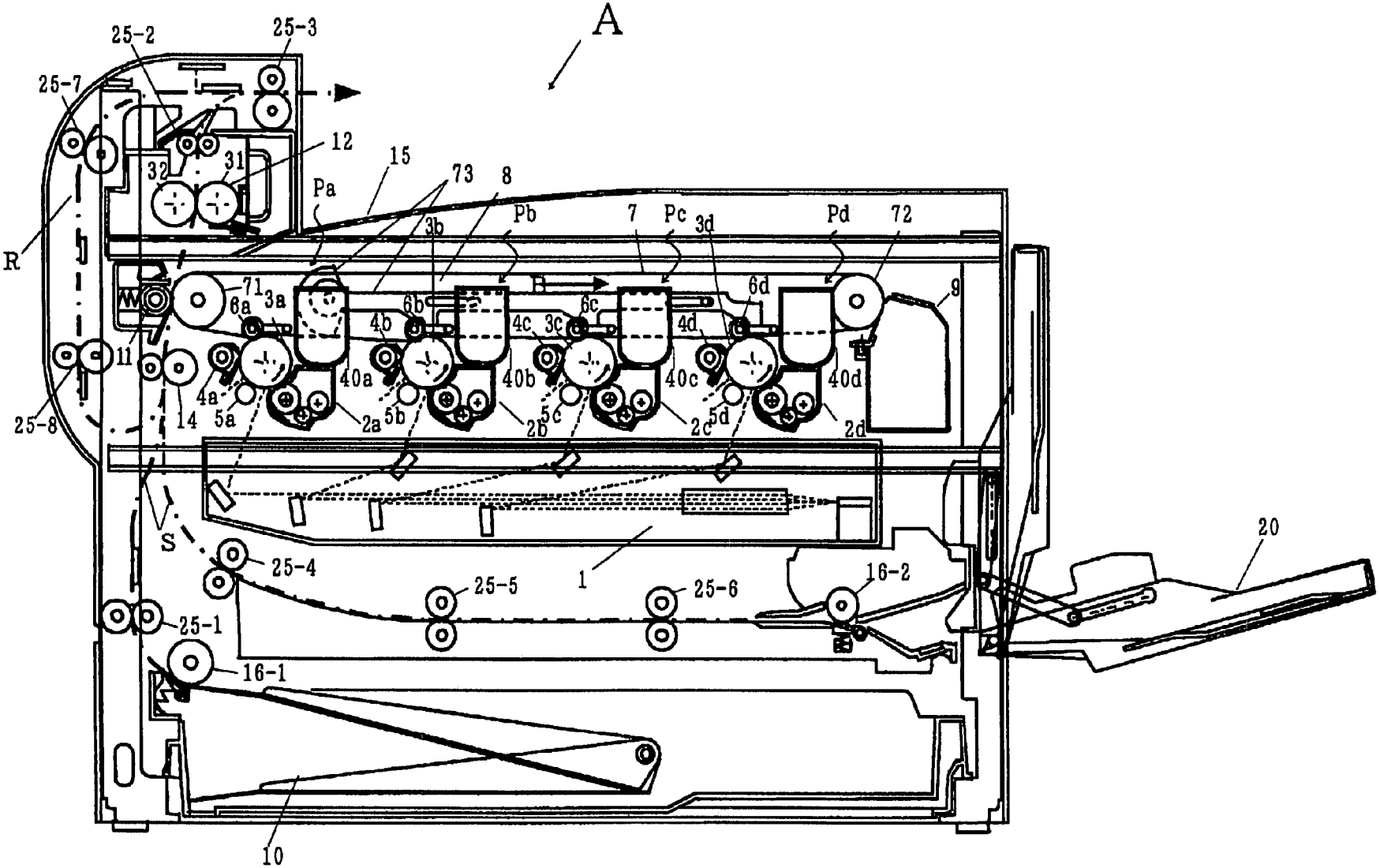
FIG. 1 is a schematic cross-sectional view of an image forming apparatus A according to the present invention.
Figure 2:
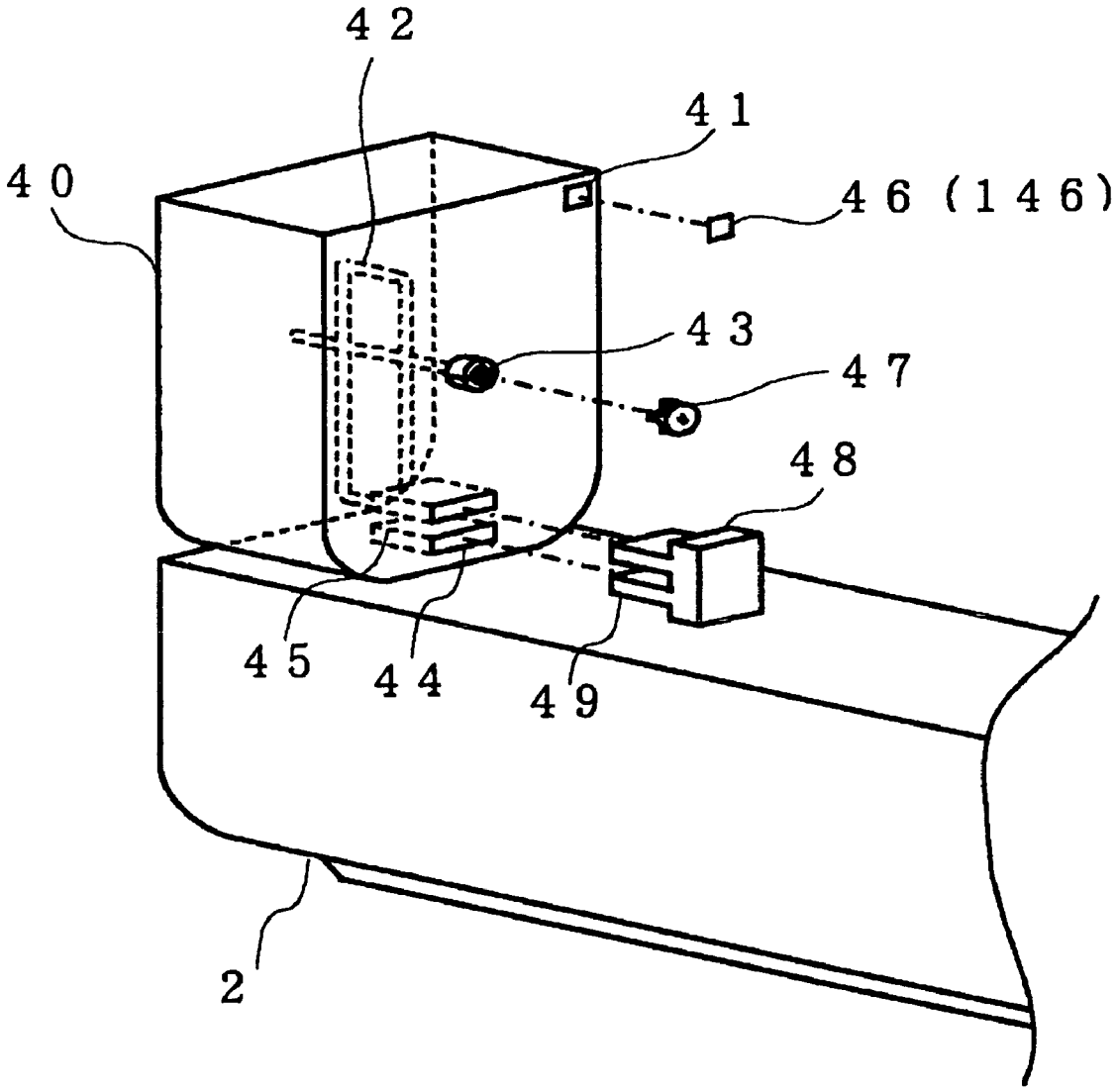
FIG. 2 is a drawing showing the minute structure of periphery of a toner cartridge unit 40 (processing unit) mounted to the image forming apparatus A.
Figure 5:
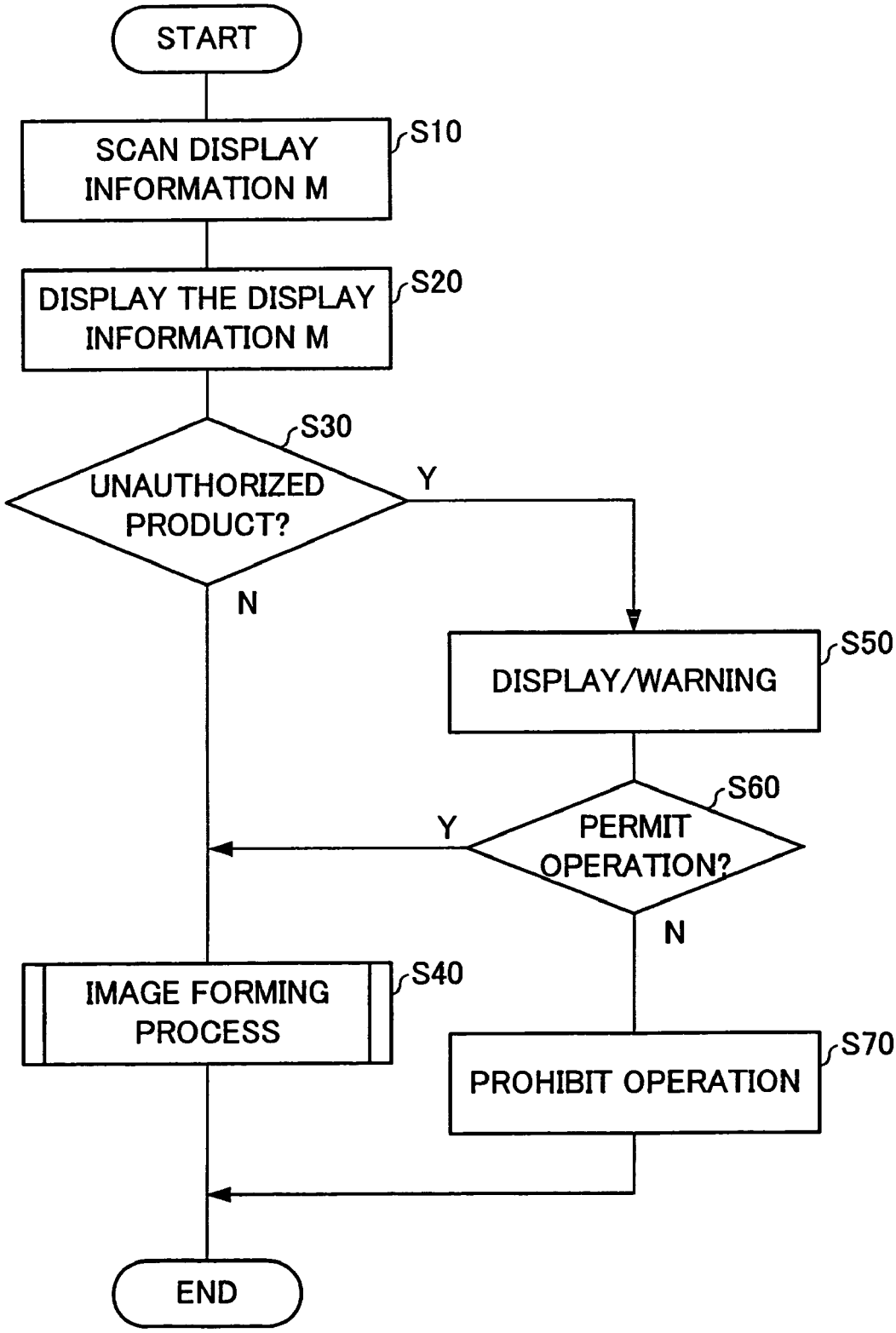
FIG. 5 is a flow chart showing an example of processing unit identification method in the image forming apparatus A.

FIG. 1 is a schematic cross-sectional view of an image forming apparatus A according to the present invention. FIG. 2 is a drawing showing the minute structure of periphery of a toner cartridge 40 (processing unit) mounted to the image forming apparatus A. FIG. 3 is a drawing showing an example of display information M. FIG. 4 is a drawing showing an example of comparison information N. FIG. 5 is a flow chart showing an example of processing unit identification method in the image forming apparatus A.

First, with the schematic cross-sectional view of FIG. 1, the following will explain a schematic structure of the image forming apparatus A according to the embodiment of the present invention, as well as an image forming process carried out in the image forming apparatus A.

The image forming apparatus A serves as an image forming section, such as a color photocopier or a color printer, which forms multicolored/monochromatic images on a recording paper or the like, according to externally-supplied image data. The image forming apparatus A is of course not limited to a color printer, but may be a printer or a photocopier forming only monochromatic images. Note that, in the present invention, the image forming apparatus A is described as a color printer for carrying out image forming based on image data containing a black (K) color component, in addition to magenta (M), cyan (C), yellow (Y), which are three primary colors on subtractive color mixture, these primary colors are obtained by color decomposition of a color image.

As described below in detail, the present embodiment relates to an image forming apparatus which enables the user to easily and securely confirm exhibition of product liability regarding a replaceable processing unit, which mounted to the image forming apparatus as a part of image forming section. Further, the image forming apparatus is also capable of displaying to the user information regarding the result of automatic comparison of compatibility of the processing unit with the image forming apparatus. This function is described later in detail.

Note that, in the present embodiment, the processing unit is described as a toner cartridge containing toner; however, the present invention is also applicable to any other processing unit serving as a part of image forming process; for example, a process cartridge.

As shown in FIG. 1, the image forming apparatus A mainly includes an exposure unit 1, development units 2 (2*a* to 2*d*), photoconductive drums 3 (3*a* to 3*d*), cleaner units 4 (4*a* to 4*d*), chargers 5 (5*a* to 5*d*), intermediate transfer rollers 6 (6*a* to 6*d*), intermediate transfer belt 7, intermediate belt unit 8, paper carriage paths R and S, paper feeder tray 10, transfer roller 11, fixing unit 12, resist roller 14, discharge tray 15, pickup rollers 16 (16-1, 16-2), manual paper feeder tray 20, carriage rollers 25 (25-1 to 25-8). These sections constitute an image forming process section.

Figure 7:
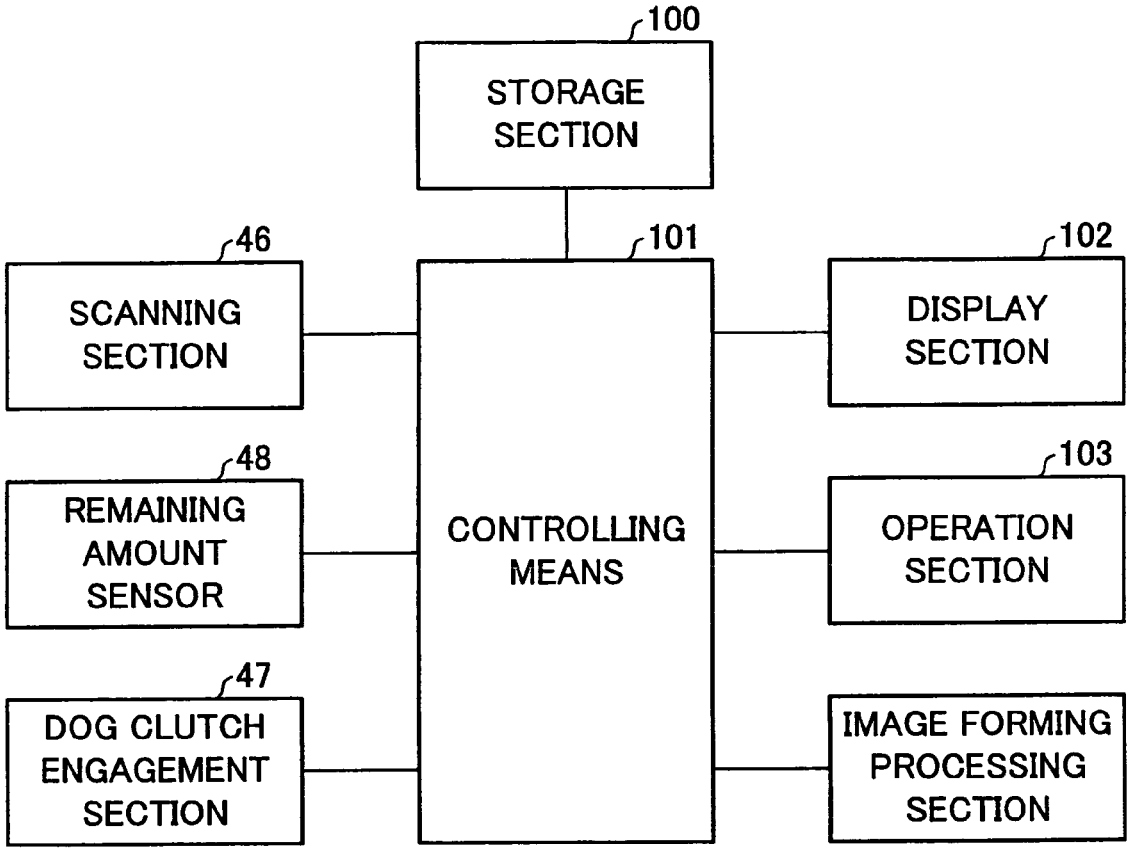
FIG. 7 is a control block diagram of an image forming apparatus A according to the present invention.

Further, as shown in FIG. 7, the image forming apparatus A mainly includes a storage section 100 made of a ROM, a RAM or the like, which stores a program for enforcing the image forming process in the image forming apparatus A; and controlling means 101 made of CPU, RAM, and other periphery devices, which carries out the image forming program. Each of image forming processes below is carried out by enforcing the image forming program stored in the storage section 100 by the controlling means 101.

The image forming apparatus A includes four development units 2 (2*a* to 2*d*), four photoconductive drums 3 (3*a* to 3*d*), four cleaner units 4 (4*a* to 4*d*), four chargers 5 (5*a* to 5*d*) and four intermediate transfer rollers (6*a* to 6*d*), corresponding to the respective color components. Further, each photoconductive drum has a toner cartridge 40 (40*a* to 40*d*; processing unit) attached thereto, respectively containing toner of black, cyan, magenta and yellow. Four image forming sections Pa to Pd are aligned in this order from the uppermost to lower of the stream in a carriage direction B (denoted by arrow B) of the intermediate transfer belt 7, so as to sequentially overlay visible toner images of black, cyan, magenta, yellow on the intermediate belt 7.

The chargers 5 serve as charging means for evenly charging the surface of the respective photoconductive drums 3 to a predetermined potential. Though the figure illustrates a contact-type charging roller, the charger 5 may be another contact-type charging roller, such as a charging brush, or a non-contact-type charger, such as a charging device.

The exposure units 1 serve to carry out exposure of the respective photoconductive drums 3 having been charged, according to image data transmitted from an external computer or the like so as to form electrostatic latent images corresponding to the image data on the surface of the photoconductive drums. In this example, each exposure unit 1 is realized by a laser scanning unit (LSU) 1 containing a laser irradiation section and a reflection mirror, but it is allowable that the exposure unit 1 is made of an EL or LED writing head in which light emitting elements are aligned in an array manner.

The development units 2 (2*a* to 2*d*) contain toner of four hues, black, cyan, magenta and yellow, respectively, supplied from the corresponding one of toner cartridges 40 (40*a* to 40*d*). Each development unit 2 (2*a* to 2*d*) visualizes a latent image of certain color formed on one of the photoconductive drums (3*a* to 3*d*), using the toner contained therein, into the toner image of one of black, cyan, magenta and yellow.

The cleaner units 4 serve to remove/collect residue toner on the surface of the respective photoconductive drums 3 after the development and image transfer are carried out.

The intermediate transfer belt unit 8 includes the intermediate transfer belt driving roller 71, the intermediate transfer belt co-driving roller 72, and an intermediate transfer belt tension mechanism 73.

The intermediate transfer belt 7 provided on an upper portion of the photoconductive drum 3 forms a loop transportation path by being hung between the intermediate transfer driving roller 71 and the intermediate transfer belt co-driving roller 72. The intermediate transfer belt 7 is adjusted to have a constant tension by the intermediate transfer belt tension mechanism 73.

The intermediate transfer belt driving roller 71 is rotated by an actuator (not shown) such as a motor so as to rotate the intermediate transfer belt 7 in the B-direction. The outer surface of the intermediate transfer belt 7 comes in contact with the photoconductive drums 3*d*, 3*c*, 3*b*, and 3*a* in this order. With the intermediate transfer belt 7 inbetween, the intermediate transfer rollers 6 (6*a*, 6*b*, 6*c*, 6*d*) are provided oppositely to the respective photoconductive drums 3*a* to 3*d*. The intermediate transfer belt 7 is formed of a film with a thickness of about 100 μm to 150 μm in the form of a loop.

The intermediate transfer roller 6 serves as means for transferring the toner image on a photoconductive drum 3 onto the intermediate transfer belt 7 in contact with the photoconductive drum 3. A high-voltage transfer bias (a high voltage with opposite polarity (+) to the voltage for charging toner (−)) is applied to the intermediate transfer roller 6.

As a result, the toner images formed on the respective photoconductive drums 3 (3*a* to 3*d*) are sequentially transferred on the outer surface of the intermediate transfer belt 7, being overlaid on each other, so that a monochrome or a color image is formed on the outer surface of the intermediate transfer belt. Here, the toner image formed on the intermediate transfer belt forms an image based on the image data inputted to the image forming apparatus A.

Each transfer roller 6 is made of a metal (such as a stainless) axis with a diameter of 8 mm-10 mm, covered by an elastic conductive material (for example, EPDM, urethane foam etc.), that allows uniform application of a high voltage to intermediate transfer belt 7. Note that, though the present embodiment uses a roller-type transfer (see FIG. 1) as an intermediate transfer electrode member, a brush-shaped electrode etc. may be used instead.

The paper feeder tray 10 contains sheets (recording paper) used for image-forming. The paper feeder tray 10 is provided beneath the exposure unit 1 of the image forming apparatus A. The manual paper feeder tray 20 is provided to allow the user to easily supply the sheets without opening/closing the paper feeder cassette 10 when the user carries out a small amount of printing. The manual paper feeder tray 20 is provided outside the apparatus body.

Further, the discharge tray 15 is provided above the image forming apparatus A so as to place the printed sheets (sheets on which images are formed). In this example, the discharge tray is a face-down tray which outputs a sheet facing down, when only one side of the sheet has a printed image.

The paper carriage path S is a path for carrying the sheets from the paper feeder tray 10 or the manual paper feeder tray 20 to the discharge tray 15 via the transfer roller 11 or the fixing unit 12. Further, in the vicinity of the paper carrying path S, small carriage rollers 25 (25-1 to 25-6), the pickup rollers 16 (16-1, 16-2), the resist roller 14, the transfer roller 11, the fixing unit 12 etc.

The pickup roller 16-1 is provided on an end portion of the paper feeder tray 10. The pickup roller 16-1 is a leading roller for supplying the sheets one by one from the paper feeding tray 10 into the paper carriage path S. The pickup roller 16-2 is provided on an end portion of the manual paper feeder tray 20, and serves as a leading roller for supplying the sheets one by one from the manual paper feeding tray 20 into the paper carriage path S. After lead into the carriage rollers 25 by the pickup roller 16-1 or the pickup roller 16-2, the sheet is further lead into the resist roller 14 by the carriage rollers 25.

Further, the resist roller 14 temporarily holds the sheet being carried by the paper carriage path S and releases the sheet and transfers the sheet onto the transfer roller 11 at a certain timing so that the front edge of the toner image thus transferred onto the intermediate transfer belt 7 comes overlaid with the edge of the sheet.

Further, the image forming apparatus A is capable of printing images with respect to both sides of the sheet. To carry out two-sided copying, the sheet thus carried to the carriage roller 25-3 is lead to the paper carriage path R with reverse-rotation of the carriage roller 25-3, and is again lead to the resist roller 14 on the paper carriage path S by the carriage roller 25-7, 25-8 provided in the vicinity of the paper carriage path R. Here, as the sheet, now upside down with the rear surface facing up, is lead to the paper carriage path S, the image forming apparatus A carries out printing on the rear surface of the sheet, the surface opposite to which an image has already been printed.

The transfer roller 11 serves to transfer the toner image on the intermediate transfer belt 7 onto the sheet being carried on the paper carriage path R. A high-voltage transfer bias (a high voltage with opposite polarity (+) to the voltage for charging toner (−)) is applied to the transfer roller 11.

The transfer roller 11 and the intermediate transfer belt driving roller 71 holds the transfer belt 7 by pressing the belt with a predetermined nip pressure. To constantly ensure the same nip, it is necessary to form one of the transfer roller 11 and the intermediate transfer belt driving roller 71 of a solid material (e.g. metal) and form the other of a soft material such as a elastic roller (elastic rubber roller, or resin foam roller etc.).

Then, the toner image on the intermediate transfer belt 7 is transferred onto the sheet as the sheet is pressed by the intermediate transfer belt 7 and the transfer roller 11, as being passed there between.

The toner adhered to the intermediate transfer belt 7 by the contact with the photoconductive drum 3, or the residue toner on the intermediate transfer belt 7, that is the toner having not been transferred onto the sheet by the transfer roller 11, may cause color mixing in the next process. To avoid this, an intermediate transfer belt cleaning unit 9 is provided to remove/collect the toner adhered to the intermediate transfer belt 7.

The intermediate transfer belt cleaning unit 9 includes, for example, a cleaning blade that is a cleaning member placed in contact with the transfer belt 7 supported by the intermediate transfer belt co-driving roller 72. The intermediate transfer belt 7 is supported by a transfer belt supporting roller 74 from the rear surface.

With a heat roller 31 and a pressure roller 32 provided therein, the fixing unit 12 fuses, mixes, presses the toner images transferred on the sheet by the transfer roller 11 and the intermediate transfer belt 7, so that the toner images are thermally fixed to the sheet.

The heat roller 31 is adjusted to a predetermined temperature by controlling means 101 based on a signal detected by a temperature detector (not shown) so as to carry out fixing with a constant temperature. The heat roller 31 and the pressure roller 32 rotate together with the sheet therebetween so as to fuse, mix, press the toner images so that the toner images are thermally fixed to the sheet. The sheet is then outputted to the discharge tray 15, and the image forming process is completed.

That are all about the schematic structure of the image forming apparatus A and the image forming process carried out in the foregoing apparatus A.

Next, with reference to FIGS. 2 through 5, the following explains a minute structure of the toner cartridge 40, which is mounted to the image forming apparatus A as a part of the image forming function, and other components of the image forming apparatus A used for identifying the toner cartridge 40. Note that, for simplicity, FIG. 2 omits the image forming apparatus A.

First, the following explains the minute structure of the toner cartridge with reference to FIG. 2.

As shown in FIG. 2, the toner cartridge 40 includes a hidden or exposed IC tag 41 (41*a*, 41*b*, 41*c*, 41*d*; storage medium). The IC tag 41 at least stores the display information M (see FIG. 3) having information of product liability (described below).

Further, the toner cartridge 40 includes a stirring member 42 (42*a*, 42*b*, 42*c*, 42*d*) for stirring toner in the toner cartridge 40. The stirring member 42 is rotatable by the rotation of the dog clutch 43 (43*a*, 43*b*, 43*c*, 43*d*) which is also rotatably provided in the toner cartridge 40.

Further, the toner cartridge 40 includes a concave section 44 (44*a*, 44*b*, 44*c*, 44*d*) having a transparent window 45 (45*a*, 45*b*, 45*c*, 45*d*) for allowing external detection of the remaining amount of toner.

Note that, to provide the transparent window 45, the wall of the concave section 44, which is protruded into the toner cartridge 40, is made of a transparent material.

Further, as shown in FIG. 7, the image forming apparatus A to which the toner cartridge is mounted includes a display section 102 including a display for showing textual/image/voice information etc., such as a speaker, a touch panel or the like, an operation section 104 for allowing the user to carry out various operations of the image forming apparatus A, a reading section 46 (46*a*, 46*b*, 46*c*, 46*d*) for reading the display information M stored in the IC tag 41 of the toner cartridge 40 without making any contacts, the dog-clutch engagement section 47 (47*a*, 47*b*, 47*c*, 47*d*) which is to be engaged with the dog-clutch 43 when the toner cartridge 40 is mounted to the image forming apparatus A, and the remaining amount sensor 48, such as an optical sensor, (48*a*, 48*b*, 48*c*, 48*d*) for detecting the remaining amount of the toner inside the toner cartridge 40 through the transparent window 45.

The remaining amount sensor 48 has a detector 49 which is to be inserted in the concave section 44 of the toner cartridge 40 when the toner cartridge 40 is inserted into the image forming apparatus A so as to detect the toner in contact with the transparent window 45. In this way, the remaining amount of toner is detected.

Further, the position of the reading section 46 is determined to allow itself to get closer to the IC tag 41 enough to read the display information M when the toner cartridge 40 is mounted to the image forming apparatus A.

Further, as shown in FIG. 7, the image forming section A further includes (i) comparison information N (described later, see FIG. 4) as a comparison object in identifying the display information M, and (ii) a processing unit identification program for enforcing the identification. The comparison information N and the processing unit identification program are stored in the storage section 100 (the first storage section (first storage means)).

Note that, in the present embodiment, the reading section 46 is only one of examples of the reading section (reading means) for reading the display information M stored in the IC tag 41 by electromagnetic wave induction without making any contacts, and the reading means is not limited to this arrangement, but may be any reading means capable of reading the display information M; for example, a contact-type or a non-contact-type magnetic card or the like. However, in this case, the IC tag 41 needs to be made of a storage medium compatible with the reading means.

Then, the toner cartridge 40 is mounted to the image forming apparatus A by the user and becomes ready to supply the toner contained therein to the development unit 2 through the opening (not shown) of the toner cartridge 40. At this stage, the dog clutch engagement section 47 is engaged with the dog clutch 43 of the toner cartridge 40, and the detector 49 of the remaining amount sensor 48 is inserted in the concave section 44 of the toner cartridge 40.

When the dog clutch engagement section 47 is rotated as required by the driving means (not shown) provided in the image forming apparatus A, such as a motor, the dog clutch 43 of the toner cartridge 40 having been engaged to the dog clutch engagement section is also rotated. The rotation of the dog clutch 43 further causes the stirring member 42 to rotate, so that the toner in the toner cartridge 40 is stirred. As a result, the supply of toner to the development unit 2 is promoted, and also sticking of toner is prevented.

The insertion of the detector 49 into the concave section 44 of the toner cartridge 40 allows the remaining amount sensor 48 to detect the remaining amount of the toner in the toner cartridge 40 through the transparent window 45 of the concave section 44. The remaining sensor 48 may be used for determination of mounting position of the toner cartridge 40, or for a sensor for confirming proper mounting.

Here, the following explains information contained in the toner cartridge 40 and the information contained in the image forming apparatus A.

As shown in FIG. 3, the display information M stored in the IC tag 41 of the toner cartridge 40 includes information regarding the toner cartridge 40, such as product name, manufacturer's serial number; name of manufacturer; materials, amount, remaining amount, expiration date of the content; cumulative number of printing (number of printed sheets); number of recycles; contact details of manufacturer; contact details of maintenance service; and manufacturing date. More specifically, the display information M stored in the IC tag 41 of the toner cartridge 40 includes, regarding the toner cartridge 40, product name; manufacturer's serial number; name of manufacturer; cumulative number of printing (number of printed sheets); number of recycles; and contact details of manufacturer; regarding the content, product name; name of manufacturer; material name; amount; remaining amount; expiration date; cumulative number of printing (number of printed sheets); recycle history information; contact details of manufacturers of processing unit and contents; contact details of maintenance service; and manufacturing date. Further, the display information M may contain any other information items to make better use of it.

On the other hand, the comparison information N stored in the storage section 100 includes information regarding the toner cartridge 40, that are product name, manufacturer's serial number; name of manufacturer; materials, amount, remaining amount, expiration date of the content; cumulative number of printing (number of printed sheets); number of recycles; contact details of manufacturer; contact details of maintenance service; and manufacturing date. More specifically, the comparison information N includes, regarding the toner cartridge 40, product name; manufacturer's serial number; name of manufacturer; cumulative number of printing (number of printed sheets); number of recycles; and contact details of manufacturer; regarding the content, product name; the name of manufacturer; material name; amount; remaining amount; expiration date; cumulative number of printing (number of printed sheets); recycle history information; contact details of manufacturers of processing unit and contents; contact details of maintenance service; and manufacturing date. FIG. 4 shows an example of part of comparison information, product name and a serial number. The comparison information also contains other items similar to these.

In the present embodiment, the concepts made up of respective information items shown above are called display information M and display information N, respectively. However, the display information and/or the comparison information in the present invention includes, regarding the processing unit, at least one of product name, manufacturer's serial number; name of manufacturer; materials; amount; remaining amount; expiration date; cumulative number of printing (number of printed sheets); number of recycles; contact details of manufacturer, contact details of maintenance service, and manufacturing date, for example.

Next, with the flow chart shown in FIG. 5, the following explains an example of processing unit identification processing procedure enforced by the controlling means 101.

The processing unit identification program can be enforced when the toner cartridge 40 is exchanged, or each time when the image forming is started, or at other times. In this example, the processing unit identification program is enforced when the toner cartridge 40 is exchanged. The number S10, S20 in the explanation below denote the numerical order of steps in the operation.

When insertion of the toner cartridge 40 into the image forming apparatus A is detected by a sensor (not shown), the processing unit identification program is enforced by the controlling means 101. As shown in FIG. 5, first, the reading section 46 of the image forming apparatus A reads the display information M stored in the IC tag 41 of the toner cartridge 40 (Step S10, corresponding to reading controlling means (reading means)).

Further, the whole or a part of the read display information M is displayed in the display section 102 (Step S20, corresponding to the display controlling means (displaying means)). The content of this display here may be determined as a part of default setting, or may be specified by user's setting operation through the operation section 103 etc. of the image forming. With this display, the user can easily see/listen the display information M.

However, to ensure safe use of the toner cartridge 40 by checking the compatibility with the image forming apparatus A based on the display information M, it is necessary to confirm the display information regarding product liability, which is generally contained in the image forming apparatus A, the main body of toner cartridge 40, the wrapping of toner cartridge, or in the manual. Checking the display information is troublesome for the user.

In this view, in Step 30, the display information M read by the reading section 46 is compared with the comparison information N stored in the storage section 100 of the image forming apparatus A, so that judgment as to whether the toner cartridge 40 is a genuine/recommended product or an unauthorized product is automatically carried out by the identification (corresponding to comparison means).

The comparison is carried out with respect to the entire or a part of contents of the display information M and the comparison information N.

As an example of the comparison in Step S30, the following explains the case of carrying out comparison based on the product name and the manufacturer's serial number (information M1 in the figure) stored in address "0000H to 003FH" of the display information M shown in FIG. 3.

First, the information M1 regarding the product name and the manufacturer's serial number is read out from the display information M stored in the IC tag 41 by the reading section 46. Here, it is assumed that the product name and the manufacturer's serial number are "A unit, A0001", respectively.

Next, information items used for comparison for the information M1 is extracted from the comparison information N stored in the storage section 100. Here, the information items are stored in the address "0000H to 0002H" of comparison information N shown in Figure.

Further, the information M1, "A unit, A0001", is compared with the information stored in the address "0000H to 0002H" of comparison information N. In this example, as shown in FIG. 4, the address "0000H" of the comparison information N coincides with "A unit, A0001" of the information M1, indicating that the toner cartridge 40 is a genuine or recommended product. When the information items of M and N are not matched, the toner cartridge 40 is regarded an unauthorized product.

When the judgment above finds the toner cartridge 40 is a genuine or a recommended product (No in Step S30), the sequence goes to Step S40, and the image forming steps are serially carried out. On the other hand, when the judgment above finds the toner cartridge 40 is not a genuine or a recommended product, that is the toner cartridge is an unauthorized product (Yes in Step S30), the sequence goes to Step S50, and the display information M and/or the comparison result is displayed in the display section 102 (Step S50, corresponding to displaying means).

In this way, the user can easily and securely confirm the display information regarding product liability of the toner cartridge 40, and/or information regarding compatibility with the image forming apparatus A of the toner cartridge 40.

An example of the display of comparison result may be text information such as, "this toner cartridge is an unauthorized product. We therefore cannot guarantee security of operation and apparatus if the cartridge is continuously used", or "Some kind of defect may occur in the apparatus". Another example may be display, to the user, of a list of genuine products or recommended products for the image forming apparatus, with a wording: "the products are compatible with xxx toner cartridge" or the like.

Further, in the present embodiment, the comparison result is displayed only when the toner cartridge 40 is an unauthorized product. However, the present invention may have an arrangement in which the result is displayed also when the toner cartridge 40 is a genuine or a recommended product.

Note that, such information does not always required to be displayed the display section 102 of the image forming apparatus A as long as it allows the user to see the information. For example, the information may be displayed in external displaying means optionally provided.

Next, after Step S50, a predetermined operation is carried out in Step S60 according to the comparison result (corresponding to Processing means).

The predetermined operation may be automatically carried out according to the comparison result. The operation may be an increase of toner usage amount in the image forming process when the toner cartridge is an unauthorized product to adjust printing density, or may be blocking of image forming operation of the image forming apparatus A using the unauthorized toner cartridge 40, so as to ensure the security and reliability of the image forming apparatus A.

However, some users may desire continuous use of the unauthorized product to reduce cost for operating the image forming apparatus A. Therefore, as described, it is not always necessary to entirely prohibit the use of the unauthorized product. Nor is the automatic adjustment of toner amount.

In view of this, the present embodiment uses a method (corresponding to the operation selecting means) for carrying out a predetermined operation selected by the user. To carry out this method, in Step S60, the user is asked to select a desired processing, and the next operation is carried out according to the user's selection. The selection by the user may be carried out by choosing one of buttons: "approve operation" and "prohibit operation" in the warning display in the display section 102 in Step S50. In this arrangement, the user confirms the display in the display section 102, and chooses one of the buttons depending on the circumstances.

An example of the arrangement above is shown in FIG. 5 in which the user is asked to decide whether the operation of image forming apparatus A is approved or prohibited when the toner cartridge 40 is an unauthorized product. It is however not necessary to make a decision in this manner.

When the user determines to continuously use the unauthorized toner cartridge 40 (choose the button of "approve operation") (Yes in Step S60), the sequence moves to the Step S40, and the image forming process is carried out with the unauthorized product, and the sequence is then finished. On the other hand, when the user determines to prohibit the use of unauthorized toner cartridge 40 (choose the button of "prohibit operation") (No in Step S60), the image forming process is stopped and terminated (Step S70).

With this arrangement, the user is given a choice whether the user approves or prohibits operation of the image forming apparatus A when the toner cartridge 40 is an unauthorized product, depending on whether the user wants to ensure security and reliability of the image forming apparatus A or the user gives weight to the cost or other factors. In this way, the user is able to determine the use of unauthorized product in the image forming process of the image forming apparatus A.

Second Embodiment

Another embodiment of the present invention is described below. For ease of explanation, materials having the equivalent functions as those shown in the drawings pertaining to First Embodiment above will be given the same reference symbols, and explanation thereof will be omitted here.

In the previous embodiment, the image forming apparatus A automatically carries out the subsequent operation according to the comparison result, or allows the user to determine how to proceed the operation. However, when the operation is automatically carried out according to the comparison result or by determination action by the user, it is more preferable that the next operation is determined also according to the usage history of processing unit, i.e., the details of the toner cartridge etc. previously used in the apparatus. With this function of reference to usage history of the image forming apparatus A, it is possible to more effectively improve security and reliability of the image forming apparatus A.

In view of this, the image forming apparatus A of the present embodiment accumulates history data of display information M of the processing unit (toner cartridge etc.) previously used in the image forming apparatus A. The accumulated data is stored in the storage section 100 (corresponding to the second storage section (second storage means)).

Therefore, as required, the controlling means 101 carries out operation for storing the display information M into the storage section 100 as history information when the image forming process is completed, or when the processing unit is mounted to the apparatus, for example.

Here, the accumulated information is stored in the storage section 100 can be easily taken out for reference. Further, the accumulated information may be stored in a different storage section (corresponding to second storage section (second storage means)) dedicatedly used for accumulation, which is separated from the storage section 100.

In this manner, it is possible to selectively carry out an appropriate operation according to the accumulated information. For example, when the accumulated information indicates that the image forming apparatus A uses an unauthorized processing unit for a long time, or more than a predetermined times, the controlling means 101 gives the user a warning by displaying a message in the display section.

Further, this arrangement also allows a service person to check the accumulated information in the maintenance service by the manufacturer etc., enabling the service person to provide various advices to the user, or to change the setting of image forming operation of the image forming apparatus A.

Third Embodiment

Still another embodiment of the present invention is described below. For ease of explanation, materials having the equivalent functions as those shown in the drawings pertaining to First and Second Embodiments above will be given the same reference symbols, and explanation thereof will be omitted here.

In the present embodiment, the structure of the image forming apparatus A is the same as those in Embodiments 1 and 2 except for an additional function (corresponding to exchange timing estimating means) of estimating the exchange timing of the toner cartridge 40 and/or other processing unit(s) mounted to the image forming apparatus A as a part of image forming function.

Since the user of the image forming apparatus A cannot estimate an appropriate exchange timing of the toner cartridge 40, the apparatus generally has a function of estimating an appropriate exchange timing (e.g. an elapse of certain time period, or completion of certain number of operations) based on the remaining amount of toner automatically detected by the sensor 48, amount of toner consumption in a single image forming operation etc.

Further, the estimation result is shown to the user as required by being displayed in the display section, thereby, according to the estimation result, the user is able to exchange the toner cartridge 40 before the toner runs out, or to prepare a new component as a replacement of the toner cartridge 40. In this manner, the trouble of unexpected toner depletion can be prevented.

However, such estimation is carried out with assumption that the image forming apparatus A uses a genuine or a recommended toner cartridge 40, and therefore it cannot deal with the case where the image forming apparatus A uses an unauthorized product. The use of an unauthorized toner cartridge 40 or other processing unit(s) may not cause any problems if the consumption and degradation of the content etc. are slower than the genuine or a recommended product, but if it is consumed or degraded more quickly than the genuine/recommended product, there is a risk that the unauthorized processing unit is continuously used in the image forming apparatus A even though the unit needs to be replaced. This may cause not only improper image forming but also bad influence to the other components.

In view of this defect, the image forming apparatus A preferably has a function (corresponding to operating means) of lowering the estimation result of exchange timing of the toner cartridge 40 or other processing unit(s) according to the comparison result or the accumulated information, or both of the comparison result and accumulated information.

With this method, the lowered estimation result of the exchange timing is displayed when it is found that the toner cartridge 40 is an unauthorized product or when the image forming apparatus A has an usage history of an unauthorized product for a long period or more than a certain number of times. On this account, it is possible to reduce the risk that the processing unit is continuously used even though the unit needs to be replaced.

Figure 6:
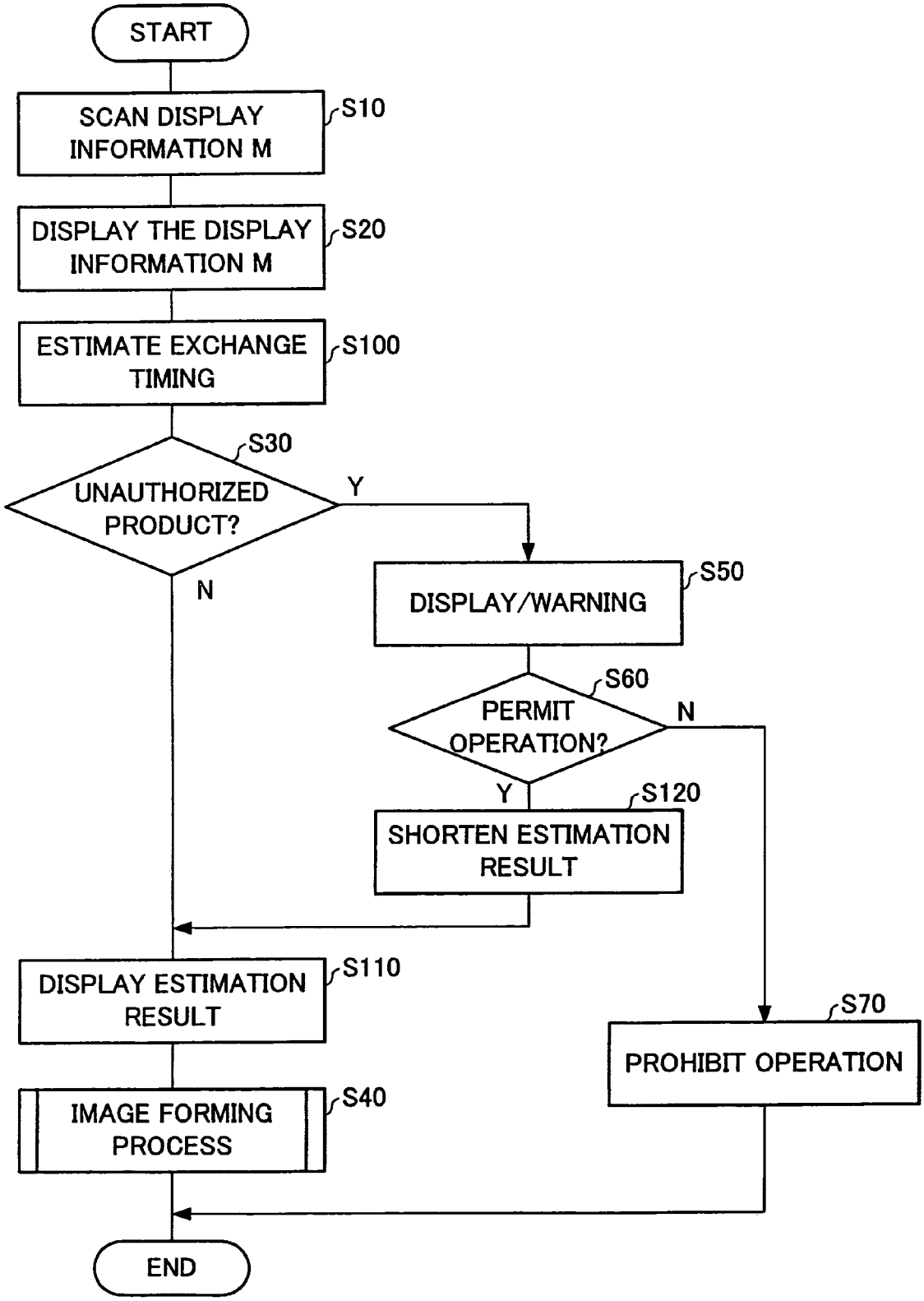
FIG. 6 is a flow chart showing another example of processing unit identification method in the image forming apparatus A.

FIG. 6 shows a flow chart showing another example of processing unit identification method in the image forming apparatus A.

With reference to FIG. 6, the following explains another example of processing unit identification method which is carried out as a processing unit identification program executed by the controlling means 101. Note that, in this explanation, operations identical to those in FIG. 5 will be given the same reference symbols, and explanation thereof will be omitted here.

As shown in FIG. 6, an image forming apparatus A in this second example further carries out Steps S100, 110, and 120 as described below, in addition to the above steps, so as to reduce the risk that the processing unit is continuously used even after the exchange timing. In this example, the reduction of estimation result is carried out with respect to the exchange timing of toner cartridge 40; however, the reduction may be carried out with respect to estimation result of other processing unit(s), which may receive some kind of bad influence from the use of unauthorized product.

[Step S100]

After the display information M stored in the IC tag 41 is read out (Step S10) and the display information M is displayed (Step S20), Step S100 is carried out so as to estimate an appropriate exchange timing (e.g. a certain time period, or a certain number of operations) based on the remaining amount of toner detected by the sensor 46, amount of toner consumption in a single image forming operation etc. The detection of toner consumption may be carried out by detecting density of toner on the sheet on which a toner image is transferred from the photoconductive drum, using reflection light amount sensor (not shown), for example.

[Step S110]

When the judgment in Step S30 finds that the toner cartridge in the apparatus is not an unauthorized product, Step S110 is carried out so as to display the estimation result in the display section. Here, it is preferably this display is updated each time according to each change in remaining toner amount or the like.

[Step S120]

When the judgment in Step S30 finds that the toner cartridge 40 in the apparatus is an unauthorized product, Step S120 is carried out so as to lower the estimation result according to the comparison result, the accumulated information etc. Then, the sequence goes to the Step S110, and the lowered estimation result is displayed in the display section.

As described, for example, when it is found that the toner cartridge 40 is an unauthorized product, or when the accumulated information indicates that the image forming apparatus A uses an unauthorized processing unit etc. for a long time, or more than a predetermined times; the image forming apparatus A of this example is capable of setting an earlier exchange timing than an image forming apparatus A using a genuine or a recommended product, thereby preventing risk that the image forming apparatus A continuously uses the unauthorized product even after the appropriate exchange timing. On this account, safety and reliability of the image forming apparatus A are ensured.

Forth Embodiment

Another embodiment of the present invention is described below. For ease of explanation, materials having the equivalent functions as those shown in the drawings pertaining to First to Third Embodiments above will be given the same reference symbols, and explanation thereof will be omitted here.

The image forming apparatuss A described in First to Third embodiments carry out comparison between the display information M and the comparison information N. However, in recycling, exchanging, or using the toner cartridge 40, there is a necessity of modification of the display information M according to the content, the number of recycles, or usage condition. Similarly, the comparison information N also needs to be modified according to any kinds of addition, modification, or deletion of a genuine product or a recommended product due to development of new products.

Accordingly, the image forming apparatus A preferably includes display information modification means for modifying the display information M, and comparison information modification means for modifying the comparison information N.

To realize this function, the storage section 100 of the image forming apparatus A stores a display information modification program for modifying the display information M, and a comparison information modification program for modifying the comparison information N. Further, by enforcing the programs by the controlling means 101, modification of the display information M and the display information N is carried out. The following more specifically describes the respective functions. The modification here refers to overwriting, writing of new information, or deletion of information.

[Display Information Modification Means]

Figure 8:
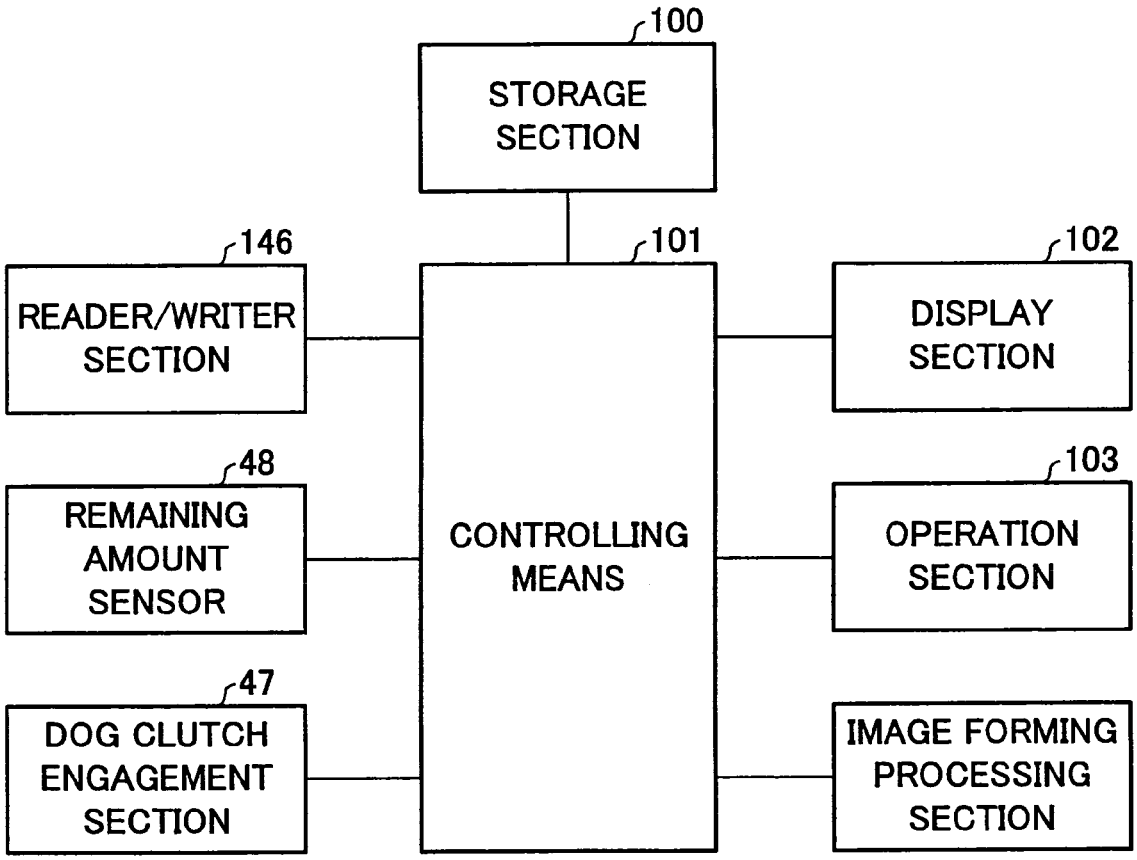
FIG. 8 is another control block diagram of the image forming apparatus A according to the present invention.

First, to modify the display information M stored in the IC tag 41 of the toner cartridge 40, as shown in FIG. 8, a reader/writer section (writing section, reading section) 146 having a function of writing modification content into the IC tag of the toner cartridge 40, for example, using a power transmission by electromagnetic induction, is provided instead of the reading section 46 which only has the function of reading the display information M. Note that, as with the reading section 46, the reader/writer section 146 is not limited to this arrangement, but may be any means capable of reading/writing of the display information M; for example, a contact-type magnetic card or the like. However, in this case, the IC tag 41 needs to be made of a storage medium compatible with the reading means.

Then, when the display modification program is carried out by the controlling means 101, the display information M is read out from the IC tag 41, and specific item(s) of the display information M is modified either automatically according to the condition, or by user's operation through the operation section of the image forming apparatus A, so that the modification content is written to the IC tag 41 of the toner cartridge 40 by the reader/writer section 146 (corresponding to the display information modification means).

Further, it is preferable that the modification is not limited to operation inside the image forming apparatus A, but is also possible by external separate modification means. This modification means may be means for modifying the display information M by accessing through some kind of communicating means to the image forming apparatus A with the toner cartridge 40 attached thereto, or may be means completely separated from the image forming apparatus A, which solely carries out modification.

In this case, the third party, the party other than the manufacturer, is also required to modify the display information M when the processing unit is recycled or the contents are changed. For this reason, it is preferable that all necessary information items, such as the format (e.g. the format for classifying plural information items into separate addresses (see FIG. 3)) or modification method (e.g. writing method), are disclosed to the public by the manufacturer on the website of the Internet or in the written manual.

[Comparison Information Modification Means]

When the comparison information modification program is carried out by the controlling means 101, the comparison information N is extracted from the storage section 100, and specific item(s) of the comparison information N is modified either automatically according to the condition, or by user's operation through the operation section of the image forming apparatus A, before these items are re-stored in the storage section 100 (corresponding to comparison information modification means).

On this account, the image forming apparatus A is capable of handling a new-type toner cartridge 40, or any addition, modification, or deletion of a genuine product or a recommended product (products accepted by the manufacturer).

As described, the present invention relates to an image forming apparatus, which at least comprises a storage medium storing display information regarding product liability, the image forming apparatus reading out the display information from the storage medium of a replaceable processing unit, which is mounted to the image forming apparatus as a part of image forming function, so as to compare the display information read with the comparison information stored in the first storage section, and display one or both of the display information and the comparison result.

With this function, the present invention provides an effect that the user easily and securely confirms display information regarding product liability of a processing unit, and/or information regarding compatibility of the processing unit with the image forming apparatus.

One or both of the display information and the comparison information is composed of at least one of: product name, manufacturer's serial number, name of manufacturer, material, amount, remaining amount, expiration date, cumulative number of printing operations, number of recycles, contact details of manufacturer, contact details of maintenance service, and manufacturing date.

The processing unit may be a replaceable toner cartridge or a process cartridge, which is mounted to the image forming apparatus as a part of image forming function. Otherwise, the processing unit may be other kinds of processing unit which needs to be exchanged after a certain time period, or depending on remaining amount of content, number of operations etc.

It is preferable that the predetermined operation is carried out according to the comparison result.

For example, when the processing unit is an unauthorized product, the operation of the image forming apparatus may be automatically stopped, or the setting of image forming operation, such as printing density, may be changed. With this function, the security and reliability of the image forming apparatus are ensured.

Here, since the usage/operation of the image forming apparatus differs for each user, it is preferable that the operation is not automatically carried out according to the comparison result but the user can select how to proceed the operation.

In this view, the present invention may be arranged so that the image forming apparatus allows the user to select operation according to the comparison result.

For example, the image forming apparatus may allow a user to approve or prohibit operation of the image forming apparatus.

With this arrangement, the user is given a choice whether the user approves or prohibits operation of the image forming apparatus when the processing unit is an unauthorized product, depending on whether the user wants to ensure security and reliability of the image forming apparatus or the user gives weight to the cost or other factors.

The image forming apparatus preferably accumulates the display information read by the reading section.

This arrangement also allows a service person to check the accumulated information in the maintenance service by the manufacturer etc., enabling the service person to provide various advices to the user, or to change the setting of image forming operation of the image forming apparatus.

In this arrangement, by storing the display information in the storage means which stores the comparison information, it is possible to suppress an increase in cost or installation space.

The present invention may be arranged so that the predetermined operation is carried out according to the accumulated display information.

For example, when the accumulated information indicates that the image forming apparatus uses an unauthorized processing unit for a long time, or more than a predetermined times, the controlling means gives the user a warning by displaying a message in the display section or changes the setting of image forming process. By thus carrying out operation according to the accumulated display information, that is, according to the usage condition of the image forming apparatus, it is possible to improve security and reliability of the image forming apparatus.

The foregoing image forming apparatus having the function of estimating exchange timing of the processing unit and/or other processing unit mounted to the image forming apparatus as a part of image forming function, it is preferable that the estimation result of exchange timing is reduced according to the display information accumulated in the second storage section, or according to both of the display information accumulated in the second storage section and the comparison result given by the comparing means.

For example, when it is found that the processing unit is an unauthorized product, or when the image forming apparatus uses an unauthorized processing unit etc. for a long time, or more than a predetermined times, and the consumption/degradation of the unauthorized processing unit is quicker than a genuine product or a recommended product; the foregoing function prevents the risk that the image forming apparatus continuously uses the unauthorized product after the exchange timing. On this account, the image forming apparatus is prevented from defects in image forming function caused by excessive usage of the processing unit.

Further, when the processing unit is recycled or is exchanged, there may be a necessity of modification of the display information according to change in content, or updating of the number of recycles etc. In this view, it is preferable that the display information of the processing unit is modifiable. Here, it is preferable that the modification is possible either by the operation inside the image forming apparatus, or by external separate modification means.

The present invention may be arranged so that the comparison information is modifiable.

On this account, the image forming apparatus is capable of handling a new-type processing unit, or any addition, modification, or deletion of a genuine product or a recommended product, thereby ensuring maintainability.

The present invention may be alternately expressed as a replaceable processing unit at least comprising a storage medium storing display information regarding product liability, the processing unit being mounted to the foregoing image forming apparatus as a part of image forming function.

In the foregoing image forming apparatus, each of the reading controlling means, the display controlling means, the comparing means, the operating means, the operation selecting means, the display information modifying means, and the comparison information modifying means may be constituted of a hardware logic, or may be realized by software with a CPU as follows.

Specifically, the image forming apparatus of the present invention includes, for example, a CPU (Central Processing Unit) for enforcing instructions of an image forming method, i.e., enforcing the command for realizing the reading controlling means, the display controlling means, the comparing means, the operating means, the operation selecting means, the display information modifying means, and the comparison information modifying means; a ROM (Read Only Memory) for storing the program; a RAM (Random Access Memory) for developing the program; and a storage device (storage medium) such as a memory for storing the program and the various data. Further, when the respective functions of the reading controlling means, the display controlling means, the comparing means, the operating means, the operation selecting means, the display information modifying means, and the comparison information modifying means are realized as software, the program code (execute form program, intermediate code program, source program) of the remote control signal reception program is stored in a program medium readable by a computer, which medium is provided to the remote control signal reception circuit. In this way, the objective of the present invention may also be achieved by reading out (enforcing) the program code stored in the storage medium by the computer (or, by CPU, MPU). In this case, the respective functions are enforced by the program code itself thus read out from the storage medium. Therefore, the storage medium storing the program code constitutes the present invention.

As in this case, any means (section) described in the present specification does not necessarily denotes physical means but may be a structure in which the foregoing functions are realized by software. Further, the present invention includes a structure in which the function of a single mean is realized by plural physical means, or functions of plural means are realized by a single physical mean.

More specifically, in the present embodiment, by storing the computer-enforceable program in a computer-readable storage medium, the program becomes mobile.

Further, when executed by a micro computer, the storage medium may be a memory (not shown), such as a program medium, for example, a ROM etc. Otherwise, the storage medium storing the program may be inserted to a program reader device which is provided as an external storage device (not shown), and is read out for execution.

In either case, the stored program is preferably realized by access of microprocessor, or may be realized in such a manner that the program is read out and is downloaded in a program storage area such as a RAM included in a general computer for execution. This program for downloading should be previously stored in the apparatus body.

Here, the program media is a storage medium removable from the apparatus body. Examples of the program medium include one fixedly holds the program code, which can be (a) a tape system such as a magnetic tape, a cassette tape or the like, (b) a disk system which includes a magnetic disk such as a floppy disk®, a hard disk or the like and an optical disk such as a CD-ROM, an MO, an MD, a DVD or the like, (c) a card system such as an IC card (inclusive of a memory card), an optical card or the like, and (d) a semiconductor memory such as a mask ROM, an EPROM, an EEPROM, a flash ROM.

Further, since the present invention can be made as a structure accessible to a communications network including the Internet, the media may be one fluidly carries the program code so that the program can be downloaded via the communications network. Further, in the case of thus downloading a program from the communication network, the program to be downloaded may be either previously stored in the main body or installed from a different storage medium.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, comprising:

a reading section which reads out information stored in a storage medium of a replaceable processing unit, which is mounted to the image forming apparatus as a part of image forming function;

a display section for displaying information;

reading controlling means for causing the reading section to read display information regarding product liability, which is stored in the storage medium;

a first storage section which at least stores comparison information used for identification of the display information read by the reading section;

comparing means for comparing the display information read by the reading section with the comparison information stored in the first storage section;

display controlling means for displaying in the display section one or both of the display information and a comparison result given by the comparing means;

operating means for carrying out a predetermined operation according to the comparison result given by the comparing means; and estimating means for estimating exchange timing of the processing unit, wherein when the processing unit is an unauthorized product, the operating means causes estimation for exchange timing to be earlier than that of the authorized product so as to prompt the user to replace the processing unit early.

2. The image forming apparatus as set forth in claim 1, wherein:

one or both of the display information and the comparison information is composed of at least one of: product name, manufacturer's serial number, name of manufacturer, material, amount, remaining amount, expiration date, cumulative number of printing operations, number of recycles, contact details of manufacturer, contact details of maintenance service, and manufacturing date.

3. The image forming apparatus as set forth in claim 1, wherein:

the processing unit is a toner cartridge or a process cartridge.

4. The image forming apparatus as set forth in claim 1, wherein:

the operating means includes operation selecting means for allowing a user to select operation according to the comparison result given by the comparing means.

5. The image forming apparatus as set forth in claim 4, wherein:

the operation selecting means allows a user to approve or prohibit operation of the image forming apparatus.

6. The image forming apparatus as set forth in claim 1, further comprising:

a second storage section for accumulating the display information read by the reading section.

7. The image forming apparatus as set forth in claim 6, wherein:

the first storage section and the second storage section are unified as a single storage section.

8. The image forming apparatus as set forth in claim 6, the operating means carrying out the predetermined operation according to the display information accumulated in the second storage section.

9. The image forming apparatus as set forth in claim 1, wherein:

the estimating means estimates exchange timing of an other processing unit mounted to the image forming apparatus as a part of image forming function.

10. The image forming apparatus as set forth in claim 1, wherein:

the operating means lowers an extimation result of exchange timing given by the estimating means, according to the display information accumulated in the second storage section ,as the predetermined condition.

11. The image forming apparatus as set forth in claim 1, further comprising:

writing means for writing information into the storage medium of the processing unit; and display information modification means for modifying the display information stored in the storage medium, using the writing means.

12. The image forming apparatus as set forth in claim 1, further comprising:

comparison information modification means for modifying the comparison information stored in the first storage section.

13. A processing unit identification program used for an image forming apparatus, the image forming apparatus comprising:

a reading section which reads out information stored in a storage medium of a replaceable processing unit, which is mounted to the image forming apparatus as a part of image forming function;

a display section for displaying information;

reading controlling means for causing the reading section to read display information regarding product liability, which is stored in the storage medium;

a first storage section which stores comparison information used for identification of the display information read by the reading section;

comparing means for comparing the display information read by the reading section with the comparison information stored in the first storage section;

display controlling means for displaying in the display section one or both of the display information and a comparison result given by the comparing means, operating means for carrying out a predetermined operation according to the comparison result given by the comparing means; and estimating means for estimating exchange timing of the processing unit, wherein when the processing unit is an unauthorized product, the operating means causes estimation for exchange timing to be earlier than that of the authorized product so as to prompt the user to replace the processing unit early, and the processing unit identification program causing a computer to execute the reading controlling means, the comparing means, the display controlling means, the operating means, and the estimating means.

14. A computer-readable storage medium which stores a processing unit identification program used for an image forming apparatus, the image forming apparatus comprising:

a reading section which reads out information stored in a storage medium of a replaceable processing unit, which is mounted to the image forming apparatus as a part of image forming function;

a display section for displaying information;

reading controlling means for causing the reading section to read display information regarding product liability, which is stored in the storage medium;

a first storage section which stores comparison information used for identification of the display information read by the reading section;

comparing means for comparing the display information read by the reading section with the comparison information stored in the first storage section;

display controlling means for displaying in the display section one or both of the display information and a comparison result given by the comparing means;

operating means for carrying out a predetermined operation according to the comparison result given by the comparing means, and estimating means for estimating exchange timing of the processing unit, wherein when the processing unit is an unauthorized product, the operating means causes estimation for exchange timing to be earlier than that of the authorized product so as to prompt the user to replace the processing unit early, and the processing unit identification program causing a computer to execute the reading controlling means, the comparing means, the display controlling means, the operating means, and the estimating means.

* * * * *